United States Patent [19]

Rice

[11] 3,938,311

[45] Feb. 17, 1976

[54] YARN STOP-MOTION DEVICE

[75] Inventor: Charles M. Rice, Candler, N.C.

[73] Assignee: Akzona Incorporated, Asheville, N.C.

[22] Filed: May 23, 1974

[21] Appl. No.: 472,829

[52] U.S. Cl. ..... 57/87; 225/106

[51] Int. Cl.[2] ..... D01H 13/16

[58] Field of Search ..... 225/106; 57/83, 86, 87, 57/34 R

[56] References Cited

UNITED STATES PATENTS 2,064,685 12/1936 Owens ..... 57/87

*Primary Examiner*—J. M. Meister
*Assistant Examiner*—Fred A. Silverberg
*Attorney, Agent, or Firm*—Craig & Antonelli

[57] ABSTRACT

A yarn stop-motion device for use with a yarn-processing apparatus comprising yarn break-detector means and yarn-severing means positioned close to each other and preferably combined in a single unit. This device is characterized in that the point at which the yarn break is detected by the device and the point at which the yarn is severed by the device are both positioned above or on the same side of the yarn-processing apparatus associated with the device.

14 Claims, 4 Drawing Figures

YARN STOP-MOTION DEVICE

This invention relates to a stop-motion device having a yarn break-detector means and a yarn-severing means in close proximity to each other and preferably combined in one unit for use with yarn transporting apparatus such as drawing, winding, twisting, and draw-twisting devices.

Heretofore, many devices have been developed for use with yarn-processing machines that cut, trap, or otherwise sever yarn in response to a break in the yarn. For example, conventional wrap-control systems for draw-twisters consist of a break-detector near the pirn, a yarn cutter above the feed roll, and an electrical, pneumatic or other interconnection between the detector and cutter.

These and other similar devices are described in the patent literature. For example, U.S. Pat. No. 3,452,531 describes an apparatus to be used in combination with a strand-winding machine for severing a yarn above a drafting system that is responsive to breaking of the yarn below the drafting system. In the apparatus disclosed, a trumpet is supported on a conventional traverse bar which reciprocally moves the trumpet laterally to the drafting system. Prior to passing through the trumpet, the yarn passes through a cutting device which is operatively associated with a counter-balanced pivotal means arranged to rest on the yarn below the drafting system. When the yarn breaks below the drafting system, the pivotal means moves downwardly to cooperate with the reciprocating trumpet to actuate the cutting means whereby the strand is severed. The pivotal means includes an arm which extends over the drafting means in contact with the yarn.

Numerous other devices are disclosed in the patent literature which also employ yarn break-detectors that are positioned away from means for causing severing or trapping of the yarn. Because the mechanical linkage or other connection between the yarn break-detector and the means for severing the yarn extends for a considerable distance through or over the yarn-processing machine, there is often difficulty in threading or stringing-up of the machine, and equipment and installation costs are increased.

Advantageously, the stop-motion device of this invention positions the yarn break-detector means and the means for severing the yarn closely adjacent to each other thereby providing a unit which can be mounted on or near a yarn-processing machine in a position that reduces costs and facilitates threading-up and maintenance of the machine. Another advantage of the present invention is that no external power source is required to effect actuation of the yarn-severing means upon detection of a yarn break.

These advantages are obtained in that the elements of the stop-motion device do not necessarily have to be arranged in the conventional yarn path on the machine, and in that the yarn path, when necessary, can be modified to accommodate the stop-motion device of this invention.

Thus, this invention contemplates a yarn stop-motion device which comprises break-detector means and yarn-severing means positioned close to each other, preferably the break-detector means and the yarn-severing means are also combined in a single unit. More particularly, this invention is directed to such a device having a supporting frame, stationary yarn guide means secured to said frame, yarn break-detector means pivotally mounted on said frame, and means for trapping or severing the yarn guided by said guide means positioned near to said yarn break-detector means. With this stop-motion device, the point at which the yarn break is detected by the device and the point at which the yarn is severed by the device are both positioned above or on the same side of the yarn-processing apparatus operatively associated with the device.

In one embodiment, the means for severing the yarn comprises a stop-member secured to the supporting frame and at least one clamp bar mounted on a pivotable support member on which a guide element of the break-detector means is located. In the preferred embodiment of the invention, the stop-member is permanent magnet and at least one clamp bar is made of a magnetic metal so that the bar will be drawn to and held by the stop-member.

The yarn guide means of the yarn stop-motion device includes a first stationary guide means mounted at one end of the frame and a second stationary guide means mounted in the middle of the frame and spaced from the first guide means with the guide means being arranged so that the yarn is guided in a substantially horizontal plane between the stop-member and a clamp bar.

The pivotal support member comprises a substantially L-shaped lever having one arm on which a clamp bar and a yarn break-detector element are mounted and another arm which is pivotally mounted on the frame. A counter-weight for effecting movement of the L-shaped lever is secured to the end of the other arm.

Advantageously, a triggering means is also provided for retaining the yarn-severing means and the yarn break-detector means of the stop-motion device in an inoperative state until the yarn is threaded-up through the device and through an associated yarn-processing apparatus.

In operation of the yarn stop-motion device of the invention, a yarn is passed through the first guide over at least one clamp bar to the second guide and is then fed to a yarn-processing machine such as a draw-twister device. Subsequently, the yarn, rather than proceeding directly to the takeup, is instead returned from the yarn-processing machine, looped over the guide element of the yarn break-detector means, and then directed downwardly to a yarn pickup means, e.g., a pirn building device.

The tension of force applied by the loop of yarn to the guide element of the break-detector means during normal operation of the yarn-processing machine maintains the yarn-severing means in an inoperative or open position.

When the yarn breaks, the pivotal break-detector means moves upward to close the yarn-severing means and the incoming yarn from a creel or like supply is trapped or held by the severing means so that the yarn is broken by the pull of a feed roll or other yarn transport device in the yarn-processing machine.

The device of this invention will be further understood from the following detailed description and with reference to the accompanying drawings wherein.

Figure 1:
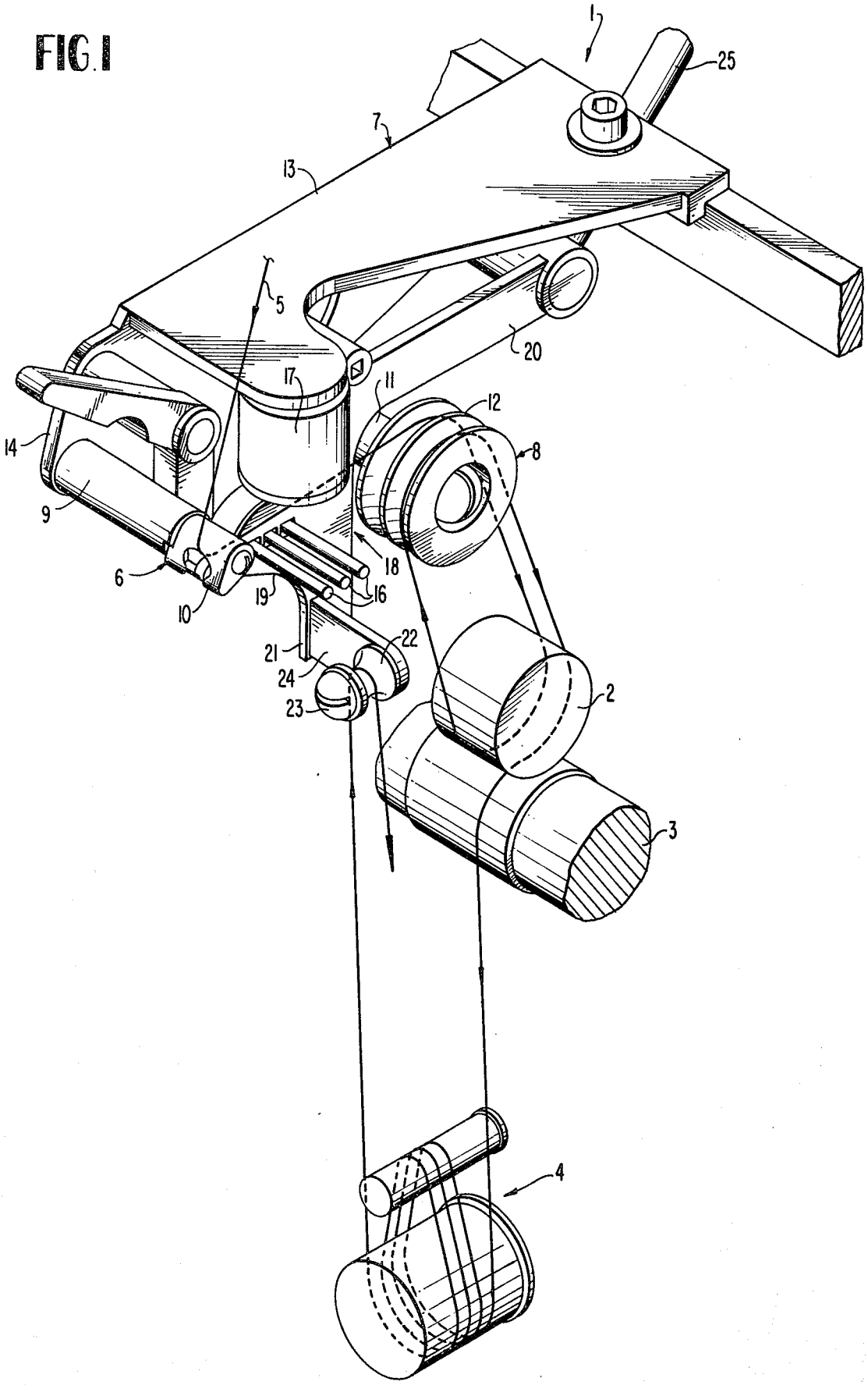
FIG. 1 is a perspective view showing the yarn stop-motion device of the invention used in connection with a yarn-processing machine, i.e., a draw-twister.

In FIG. 1, reference numeral 1 designates the yarn stop-motion device of the invention positioned above a pair of rolls including a presser roll 2 and a feed roll 3, and a draw-twister device 4 that includes a pirn building means (not shown). A yarn thread 5 is passed from a creel position initially through the yarn-severing means of the stop-motion device to the feed roll 3 and then fed to the draw-twister device 4 wherein the yarn is fed backwardly up and over the yarn break-detector means of the stop-motion device. The yarn is then directed downwardly to the pirn building means of the draw-twister device.

Figure 2:
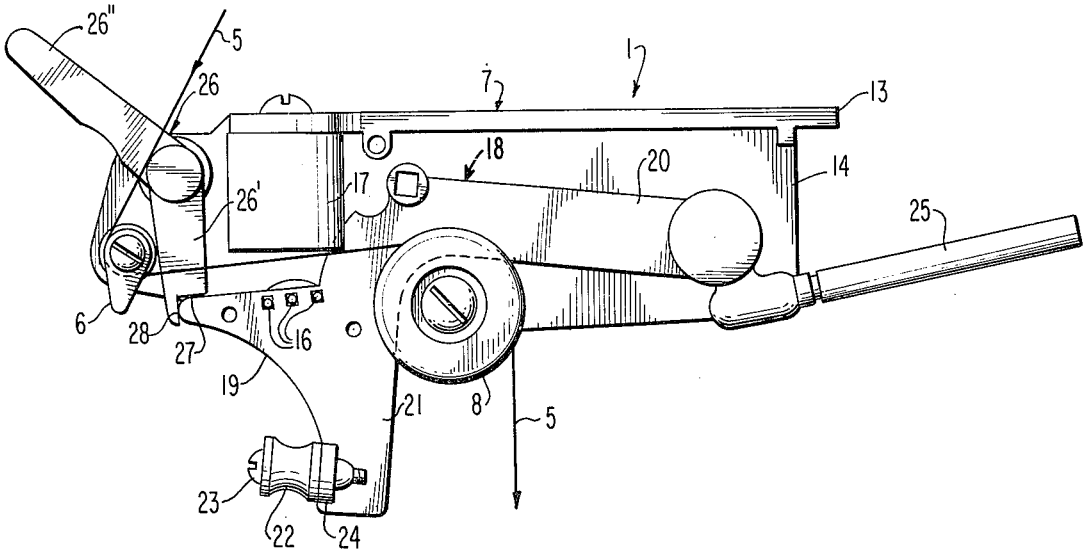
FIG. 2 is a front elevational view of the stop-motion device with the device retained in an inoperative position.

In order to thread up the stop-motion device, it is desirable to place the device in its inoperative position. This position is illustrated in FIG. 2. In this FIGURE, the yarn 5 is initially passed over a first stationary guide means 6 which is secured to the supporting frame 7. The yarn is then passed over a second stationary guide means 8 downwardly towards the pressure and feed rolls 2, 3.

The first guide means 6, as illustrated in FIG. 1, includes a support 9 which is secured to frame 7 and a ceramic guide element 10 having a notched or cut-out portion providing a guide channel for the yarn.

The second guide means 8 comprises a support 11 and a spool-type ceramic guide element 12. This element has a plurality of circular or annular guide channels for the yarn. Suitable ceramic material for the guide element includes aluminum oxide, for example.

Frame 7 is made of a suitable rigid material, for example, a synthetic polymer resin, cast metal, sheet metal or the like. Preferably the frame 7 is extruded or molded from nylon and has, as shown in FIG. 1, an angular body consisting of a horizontal supporting member 13 and a vertical supporting member 14. Preferably supports 9 and 11 of the first and second guide means, respectively, are integrally formed portions of the frame 7.

Between the first and second guide means is located the yarn severing means which comprises at least one clamping bar 16 and a stop-member 17. As viewed in FIGS. 1 and 2, the clamping bars 16 are secured to a pivotal support member 18 which is pivotally mounted at the right-hand end of the frame 7. The stop-member 17 is a permanent magnet and is secured to the horizontal support member 13 of the frame.

The pivotal support member has an L-like shape and includes a first arm 20 which is mounted onto the frame 7 and a second are 21 which extends approximately perpendicular to the first arm. This second arm is arranged to extend between the first and second guide means. A projection 19 extends laterally away from the second arm. The clamping bars 16, preferably made of a magnetic stainless steel, are mounted on the projection and are positioned directly below the stop-member 17. It is preferable that the clamping bars 16 are each loosely mounted at one end so that they all can align themselves with the lower face of the stop-member 17 when the yarn-severing means is actuated as hereinafter described in greater detail.

A yarn break-detector element 22 is secured to the free end of the second arm 21. This element comprises a ceramic spool-like member and is mounted via a screw 23 and a bracket 24 onto the arm 21. The bracket 24 extends perpendicular to the arm so that the axis of the yarn break-detector element is parallel to the plane of arm 21.

At the other end of the pivotal support member is provided a counter-balance weight 25 in the form of a metal rod. This weight serves to bias the pivotal support member for a clockwise movement towards the horizontal support member of the frame and towards the stop-member secured thereto. It will be recognized that other suitable biasing means may be provided for effecting movement of the support member towards the stop-member, e.g. a spring; preferably a counterbalance weight is employed since it requires less maintenance and provides greater reliability of operation.

The pivotal support member is held in the position shown in FIG. 2 by a trigger means comprising a two-arm lever 26, which is pivotally mounted on frame 7, and the projection 19 which extends from arm 21. One arm 26′ of the lever is provided with bearing surfaces 27 and 28 placed at right angles to each other. These surfaces contact the end portion of projection 19 when the lever is pivoted or rotated to a locking position to engage the projection 19. In the locking position illustrated, the biasing force produced by the counterweight 25 causes the projection to push upwardly against bearing surface 27 so that bearing surface 28 contacts the end of the projection 19 and prevents lateral movement of lever 26. When the lever is initially placed in its locking position, the front edge of arm 26′ contacts support 9 which thereby acts as a stop for movement of the lever.

Figure 3:
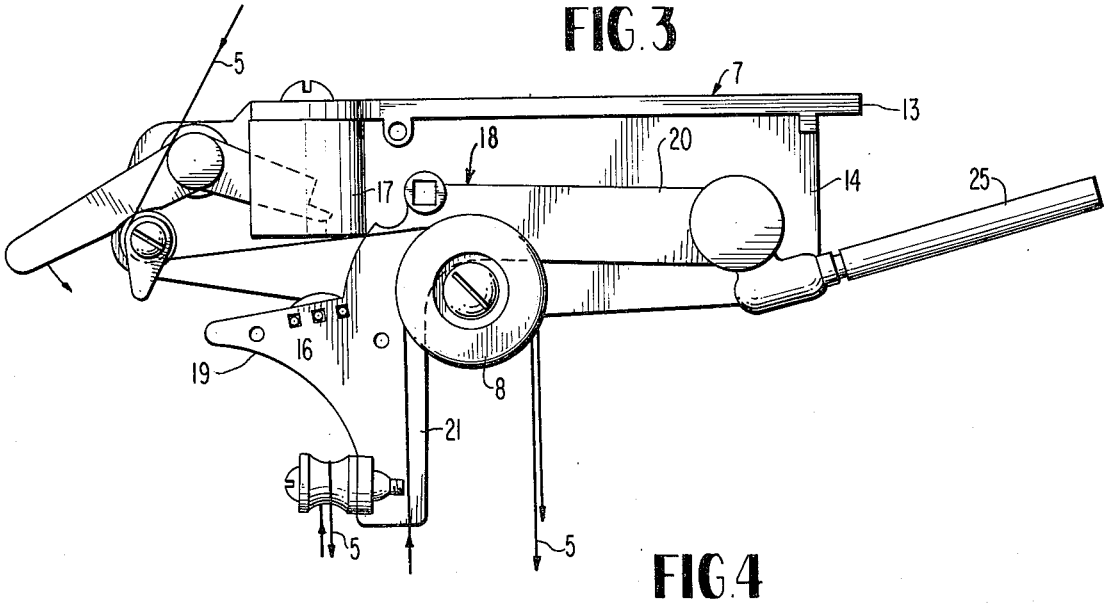
FIG. 3 is a front elevational view of the stop-motion device in its operative position for detecting a break in the yarn passing through an associated yarn-processing machine.

The other end of lever 26, i.e, arm 26″, acts as a counter-weight which causes the lever to rotate counterclockwise to the position shown in FIG. 3 when the projection is moved downwardly.

In the final stage of stringing-up the yarn stop-motion device of this invention, the yarn 5 is looped over the detector element 22 and is then returned to the pirn building means of the draw-twister device 4. With this arrangement, the loop of yarn applies a force to the break-detector element 22 and to the pivotal support member 18 so that these parts are moved downwardly to place the stop-motion device in its operating position. The downward movement of the pivotal support member is limited by contact with support 11 of the second guide means. The operating position of the stop-motion device is illustrated in FIG. 3. As previously noted, in this position lever 26 is released and automatically rotates counterclockwise in the direction of the arrow so that arm 26″ contacts support 9. It will be recognized that this arrangement of the trigger means enables an operator of the yarn-processing machine to actuate the stop-motion device by simply looping the yarn over detector element 22 without the necessity of manually releasing the trigger.

Figure 4:
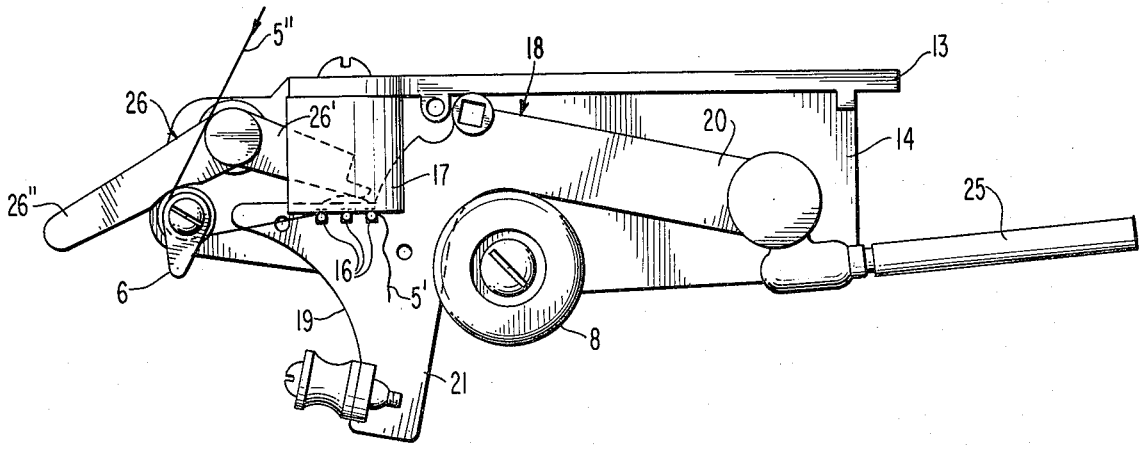
FIG. 4 is a front elevational view of the stop-motion device after detection of a yarn break with the yarn-severing means in its closed or operative position.

In the position shown in FIG. 4, the yarn 5 has been broken during its travel through the draw-twisting device 4 and as a consequence the loop of yarn over element 22, has been pulled away. When this occurs, the counter-weight 25 causes the pivotal support member 18 to rotate clockwise so that the yarn-severing means provided by stop-member 17 and clamping bars 16 is actuated, i.e., the metal clamping bars swing upwardly and are drawn to and held fast by the magnet forming the stop-member. In this manner, the yarn 5 is trapped between the clamping bars and stop-member. Moreover, because the clamping bars are mounted to allow independent movement, all of the bars provide a gripping action that insures that a yarn of small denier will be retained. Subsequently, during the continual pull of yarn by feed roller 3, the yarn is severed and the loose end of yarn 5' falls from the yarn-severing means as shown. At the same time, yarn end 5'' leading to the supply package is gripped by the clamping bars so that this end does not fly about the creel entangling other ends and so that it is in a position easily available to the operator when the device is rethreaded.

In this manner, the stop-motion device of the present invention prevents a substantial amount of yarn from being drawn in by the feed roll and onto the draw-twister device after a breakage in the yarn has occurred, thereby preventing large wraps or snarls and tangles of yarn within the draw-twister device.

In order to again actuate the stop-motion device after the small amount of waste yarn has been removed from the draw-twister apparatus, the triggering means is placed in its locking position and the stop-motion device and the draw-twister device are again threaded-up in the manner heretofore described with reference to FIG. 2. It will be further understood that the specific number of wraps required for threading or stringing-up the draw-twister apparatus illustrated in FIG. 1 are merely illustrative of one specific string-up procedure and other arrangements and other yarn-processing devices or machines can be used in association with the yarn stop-motion device of the present invention. Also, it will be recognized that the number of loops of yarn which are placed over the second stationary yarn guide means is determined by the denier and other properties of the yarn being processed. In the arrangement shown in FIG. 1, the yarn from guide element 12 is initially looped around the presser roll and then over a second channel provided in element 8 before being passed between the presser roll and feed roll 3 and being introduced into the draw-twister device.

It will be understood that the stop-motion device as described herein is particularly suitable for use with yarn-processing apparatus wherein very small denier yarns are employed, especially yarns for hosiery and the like. However, it is considered that within the scope of the present invention, the clamp bars 16 may be replaced with knife-edge apparatus or other means to permit the cutting of heavy denier yarns.

It will also be appreciated that the device of the invention is preferably in the form of a single unit in that the frame which supports the other elements is an integral element. However, it is apparent that the frame may be formed of two or more parts which when assembled, are mounted closely adjacent to each other to provide, in effect, a single unit.

While the novel embodiments of the invention have been described, it will be understood that various omissions, modifications and changes in these embodiments may be made by one skilled in the art without departing from the spirit and scope of the invention.

What is claimed is:

1. A yarn stop-motion device for use with a yarn-processing apparatus, which comprises a single yarn break-detector means and yarn-severing means positioned close to each other, the point at which a yarn break is detected by the yarn break-detector means and the point at which the yarn is severed by the yarn-severing means being positioned above or on the same side of the yarn-processing apparatus, and said yarn break-detector means detecting yarn breaks occurring along the entire yarn path of the yarn passing through the yarn-processing apparatus and being positioned to contact the yarn in the yarn path downstream of the yarn-processing apparatus.

2. The device of claim 1, wherein a triggering means is included which holds the device in an inoperative position during threadup and which is automatically released when the device is completely threaded.

3. The device of claim 1, wherein the yarn break-detector means and the yarn-severing means are combined in a single unit.

4. The device of claim 1, wherein said yarn break-detector means includes a yarn guide element for guiding a yarn passing through said yarn-processing apparatus.

5. A yarn stop-motion device operatively associated with a yarn-processing apparatus, said device comprising a supporting frame, stationary guide means secured to said frame, a single yarn break-detector means pivotally mounted on said frame and means for severing a yarn guided by said guide means positioned near to said yarn break-detector means, said yarn break-detector means detecting yarn breaks occurring along the entire yarn path of a yarn passing through said yarn-processing apparatus and being positioned to contact the yarn in the yarn path downstream of the yarn-processing apparatus.

6. The device of claim 5, wherein said stationary guide means includes a first guide means mounted at one end of the supporting frame and a second guide means mounted in the middle of the supporting frame and spaced from the first guide means, said first and second guide means being so arranged on said frame that a yarn is guided in a substantially horizontal plane.

7. The device of claim 6, wherein said means for severing said yarn has an operative position in which the stop-member and the at least one clamp bar contact each other and an inoperative position in which the stop-member and the at least one clamp bar are spaced from each other; the yarn being guided by said first and second guide means when the yarn severing means is in its inoperative position.

8. The device of claim 5, further comprising a triggering means for retaining the yarn-severing means and the yarn break-detector means in an inoperative state during thread-up of the device.

9. The device of claim 5, wherein said yarn break-detector means includes a yarn guide element for guiding a yarn passing through said yarn-processing apparatus.

10. A yarn stop-motion device comprising a supporting frame, stationary guide means secured to said frame, yarn break-detector means pivotally mounted on said frame and means for severing a yarn guided by said guide means positioned near to said yarn break-detector means, said means for severing the yarn comprising a stop-member secured to the supporting frame and at least one clamp bar on a pivotal support member, and said yarn break-detector means including a yarn guide element mounted on said pivotal support member.

11. The device of claim 10, wherein the stop-member is a permanent magnet and the at least one clamp bar is made of a magnetic metal whereby said bar is drawn to and retained by said stop-member when bar is in the proximity of said stop-member.

12. The device of claim 10, wherein said pivotal support member comprises a substantially L-shaped lever having one arm on which at least one clamp bar is mounted near said yarn guiding element and another arm which is pivotally mounted on said supporting frame, said yarn break-detector means further comprising a counterweight for effecting movement of the L-shaped lever secured to the end of the other arm.

13. A yarn stop-motion device comprising a supporting frame, stationary guide means secured to said frame, yarn break-detector means pivotally mounted on said frame, means for severing a yarn guided by said guide means positioned near to said yarn break-detector means, and a triggering means for retaining the yarn-severing means and the yarn break-detector means in an inoperative state during thread-up of the device, said triggering means comprising a two-arm lever pivotally mounted on said supporting frame and a projection extending from the one arm of said pivotal support member, said two-arm lever contacting said projection when the yarn-severing means and the yarn break-detector means are in an inoperative state.

14. The device of claim 13, in which said two-arm lever has one arm provided with bearing surfaces for contact with said projection, said bearing surfaces being placed at right angles to each other.

* * * * *